US007591211B2

(12) United States Patent
Tseng et al.

(10) Patent No.: US 7,591,211 B2
(45) Date of Patent: Sep. 22, 2009

(54) CUTTING APPARATUS

(75) Inventors: Tzu-Feng Tseng, Taipei (TW); Pei-Yuan Lee, Taipei (TW)

(73) Assignee: Primax Electronics, Inc., Taipei (TW)

( * ) Notice: Subject to any disclaimer, the term of this patent is extended or adjusted under 35 U.S.C. 154(b) by 209 days.

(21) Appl. No.: 11/625,521

(22) Filed: Jan. 22, 2007

(65) Prior Publication Data

US 2008/0072730 A1 Mar. 27, 2008

(30) Foreign Application Priority Data

Sep. 8, 2006 (TW) ..... 95133177

(51) Int. Cl.
*B26D 1/06* (2006.01)

(52) U.S. Cl. ..... 83/628; 83/635

(58) Field of Classification Search ..... 83/628, 83/602, 629, 635

See application file for complete search history.

(56) References Cited

U.S. PATENT DOCUMENTS 2,303,760 A * 12/1942 Rafter ..... 83/530
4,195,564 A * 4/1980 Shiokawa ..... 100/231
4,257,295 A * 3/1981 Patel ..... 83/374
4,987,811 A * 1/1991 Ikarashi et al. ..... 83/372
2003/0033922 A1 * 2/2003 Scott ..... 83/582

* cited by examiner

*Primary Examiner*—Kenneth E Peterson
(74) *Attorney, Agent, or Firm*—Kirton & McConkie; Evan R. Witt

(57) ABSTRACT

A cutting apparatus includes a motor, a gear set, a gliding block, a rotating shaft and a handling element. The gear set includes a first gear part connected to the motor and a second gear part connected to a protrusion member. The center line of the protrusion member is shifted from the center line of the second gear part. The gliding block includes a gliding channel for receiving the protrusion member therein. The protrusion member is linearly moved along the gliding channel back and forth when the protrusion member is rotated in a circular motion. The rotating shaft is connected to an end of the gliding block such that the rotating shaft is rotated with synchronous linear movement of the protrusion member. The handling element has a first end sheathed around the rotating shaft and a second end operated to have the cutting member linearly moved along two guiding tracks.

17 Claims, 4 Drawing Sheets

CUTTING APPARATUS

FIELD OF THE INVENTION

The present invention relates to a cutting apparatus, and more particularly to an automatic cutting apparatus

BACKGROUND OF THE INVENTION

Conventionally, cutting apparatuses are used for cutting sheet articles such as papers. Typically, the cutting apparatuses are classified into two types, i.e. a small-size manual cutting apparatus for use in homes or offices and a large-size automatic cutting apparatus for use in factories. In other words, the cutting apparatuses applied to homes or offices are usually small and manually operated. Nowadays, since the cutting apparatuses are developed toward increasing diversity, many different types of cutting apparatuses are disclosed. For example, a small-size automatic cutting apparatus is disclosed in Taiwanese Patent Publication No. 1239280, and the contents of which are hereby incorporated by reference.

As known, the configurations of the small-size automatic cutting apparatuses are complicated and costly. For complying with different thickness specifications of sheet articles, many components included in the automatic cutting apparatuses should be replaced with new ones. In other words, the application of individual automatic cutting apparatus is limited. Therefore, there is a need to provide a cutting apparatus having extensible applications and simple configurations.

SUMMARY OF THE INVENTION

It is an object of the present invention to provide a cutting apparatus having simple configurations.

It is another object of the present invention to provide a cutting apparatus having extensible applications.

In accordance to a first aspect of the present invention, there is provided a cutting apparatus. The cutting apparatus includes a cutting platform, a first lateral plate and a second lateral plate, a first guiding track and a second guiding track, a motor, a gear set, a cutting member and a rotational direction switching unit. The first lateral plate and the second lateral plate are arranged at opposed sides of the cutting platform. The first guiding track and the second guiding track are arranged on the first lateral plate and the second lateral plate, respectively, and face to each other. The motor is disposed on the cutting platform. The gear set includes a first gear part and a second gear part disposed on a first surface and a second surface of the second lateral plate, respectively. The first gear part is connected to the motor, the second gear part is connected to a protrusion member, and the center line of the protrusion member is shifted from the center line of the second gear part. The cutting member is arranged between the first guiding track and the second guiding track and movable along the first guiding track and the second guiding track. The rotational direction switching unit is interconnected between the protrusion member and the cutting member and includes a gliding channel for receiving the protrusion member therein. The rotational direction switching unit renders a linear cutting operation of the cutting member when the protrusion member is driven by the gear set to rotate in a circular motion.

In an embodiment, the first guiding track and the second guiding track are arranged in a vertical direction such that the cutting member is moved along the first guiding track and the second guiding track to implement the linear cutting operation in the vertical direction.

In an embodiment, the protrusion member is a cylindrical post disposed on a side surface of the second gear part.

In an embodiment, the protrusion member is substantially a crank including a protrusion arm, a first cylindrical post and a second cylindrical post. The first cylindrical post and the second cylindrical post are respectively formed on an upper end and a lower end of the protrusion arm. The first cylindrical post is pivotally coupled to the gear set at the center line thereof such that the center line of the second cylindrical post is shifted from the center line of the gear set.

In an embodiment, the cutting member has a slanted and curved knife edge.

In an embodiment, the rotational direction switching unit comprises a gliding block, a rotating shaft and a handling element. The gliding block includes the gliding channel for receiving the protrusion member therein. The protrusion member is linearly moved along the gliding channel back and forth when the protrusion member is rotated in the circular motion, wherein the center line of the gliding channel is shifted from the center line of the gliding block. The rotating shaft has a first end and a second end penetrating through the first lateral plate and the second lateral plate, respectively. The second end of the rotating shaft is connected to an end of the gliding block such that the rotating shaft is rotated with synchronous linear movement of the protrusion member of the gliding block. The handling element has a first end sheathed around the rotating shaft and a second end in contact with a sidewall of a hole of the cutting member. The handling element is upwardly or downwardly sustained against the sidewall of the hole such that the cutting member is linearly moved along the first guiding track and the second guiding track.

In an embodiment, the gliding channel is adjacent to a side of the gliding block, and defined by a first arc-shaped end part, a second arc-shaped end part, a first sidewall, a second sidewall and a bottom surface, wherein the first sidewall and the second sidewall are parallel with each other and connected between the first arc-shaped end part and the second arc-shaped end part.

In an embodiment, the gliding channel is a hollow gliding channel defined by a first arc-shaped end part, a second arc-shaped end part, a first sidewall and a second sidewall, wherein the first sidewall and the second sidewall are parallel with each other and connected between the first arc-shaped end part and the second arc-shaped end part.

In an embodiment, the handling element includes a ring-shaped collar and a protrusion rod. The ring-shaped collar is sheathed around the rotating shaft. The protrusion rod is extended from the ring-shaped collar and sustained against the sidewall of the hole.

In an embodiment, the protrusion rod of the handling element has an inclined upper surface and/or an inclined lower surface sustained against the sidewall of the hole.

In accordance to a second aspect of the present invention, there is provided a cutting apparatus. The cutting apparatus includes a motor, a gear set, a gliding block, a rotating shaft and a handling element. The gear set includes a first gear part and a second gear part. The first gear part is connected to the motor, the second gear part is connected to a protrusion member, and the center line of the protrusion member is shifted from the center line of the second gear part. The gliding block includes a gliding channel for receiving the protrusion member therein. The protrusion member is linearly moved along the gliding channel back and forth when the protrusion member is driven by the gear set to rotate in a circular motion. The rotating shaft has a first end and a second end penetrating through a first lateral plate and a second lateral plate, respectively. The second end of the rotating shaft is connected to an end of the gliding block such that the rotating shaft is rotated with synchronous linear movement of the protrusion member of the gliding block. The handling element has a first end sheathed around the rotating shaft and a second end operated to have the cutting member linearly moved along a first guiding track and a second guiding track, which are arranged on said first lateral plate and said second lateral plate, respectively.

In accordance to a third aspect of the present invention, there is provided a cutting apparatus. The cutting apparatus includes a motor, a first lateral plate and a second lateral plate, a first guiding track and a second guiding track, a gear set, a cutting member, a rotating shaft, a gliding block and a cutting structure. The first guiding track and the second guiding track are arranged on the first lateral plate and the second lateral plate, respectively. The gear set includes a first gear part and a second gear part disposed on a first surface and a second surface of the second lateral plate, respectively. The first gear part is connected to the motor, the second gear part is connected to a protrusion member, and the center line of the protrusion member is shifted from the center line of the second gear part. The cutting member is arranged between the first guiding track and the second guiding track and movable along the first guiding track and the second guiding track. The rotating shaft has a first end and a second end penetrating through the first lateral plate and the second lateral plate, respectively, wherein the second end of the rotating shaft is adjacent to the protrusion member. The gliding block is interconnected between the protrusion member and the rotating shaft and includes a gliding channel for receiving the protrusion member therein. The second end of the rotating shaft is connected to an end of the gliding block such that the rotating shaft is rotated with synchronous linear movement of the protrusion member of the gliding block. The protrusion member is linearly moved along the gliding channel back and forth when the protrusion member is driven by the gear set to rotate in a circular motion. The cutting structure includes a cutting member pivotally coupled to the rotating shaft and movable along the first guiding track and the second guiding track in response to rotation of the rotating shaft.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 2(*b*) is a schematic partial side view illustrating the gliding block included in the cutting apparatus of FIG. 1;

FIG. 4(*b*) is a schematic partial side view illustrating the gliding block included in the cutting apparatus of FIG. 3.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
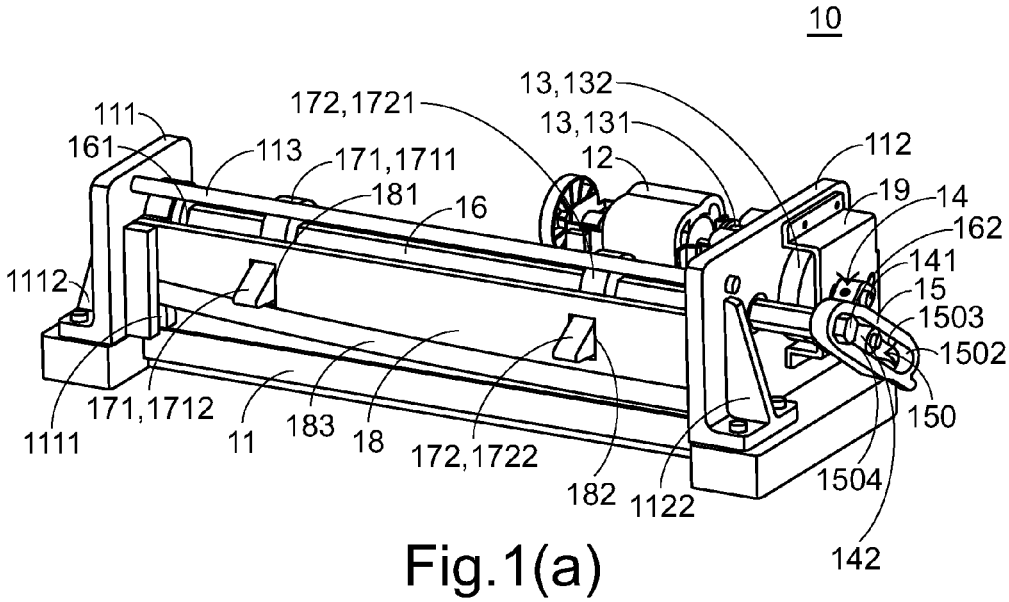
FIGS. 1(*a*), 1(*b*), 1(*c*) and 1(*d*) are schematic perspective views illustrating successive operations of a cutting apparatus according to a preferred embodiment of the present invention.
Figure 1B:
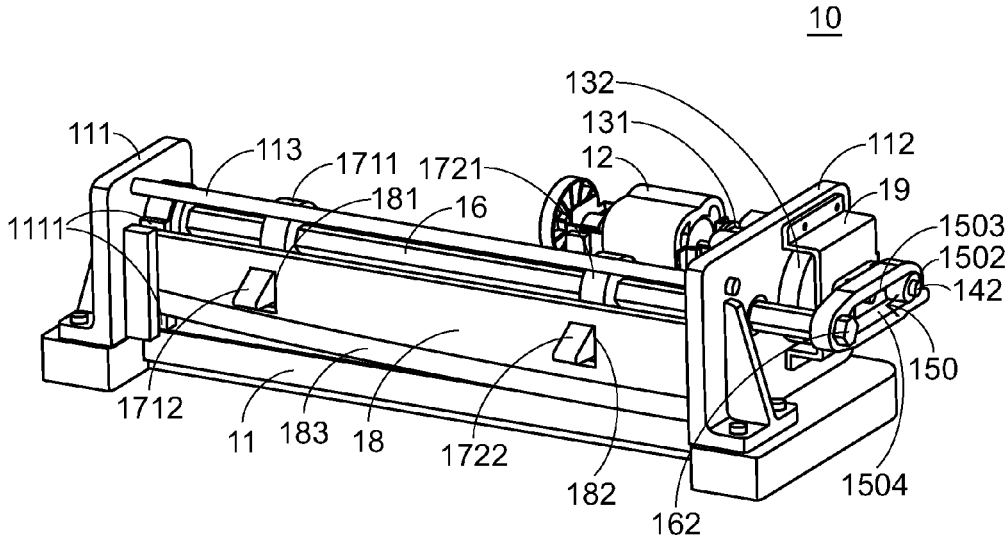
Figure 1C:
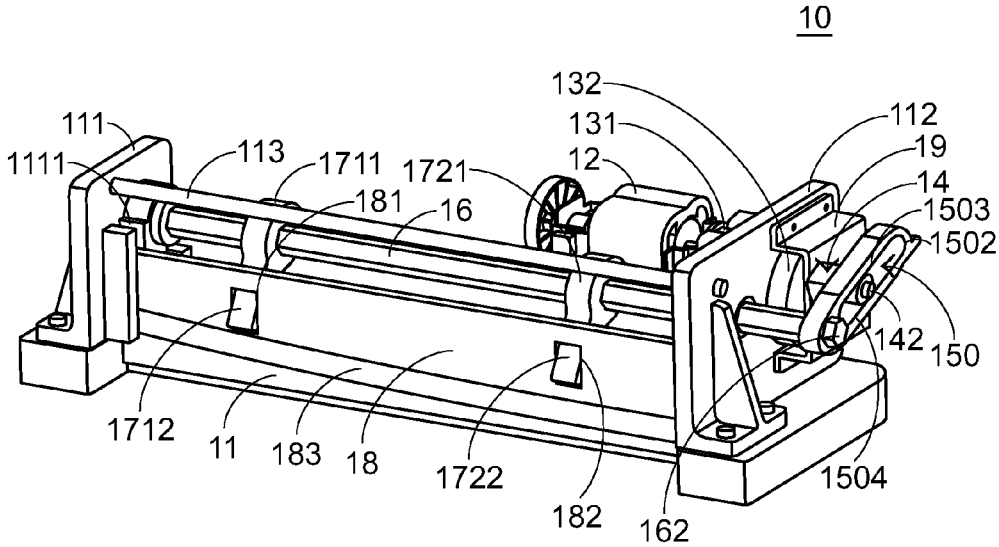
Figure 1D:
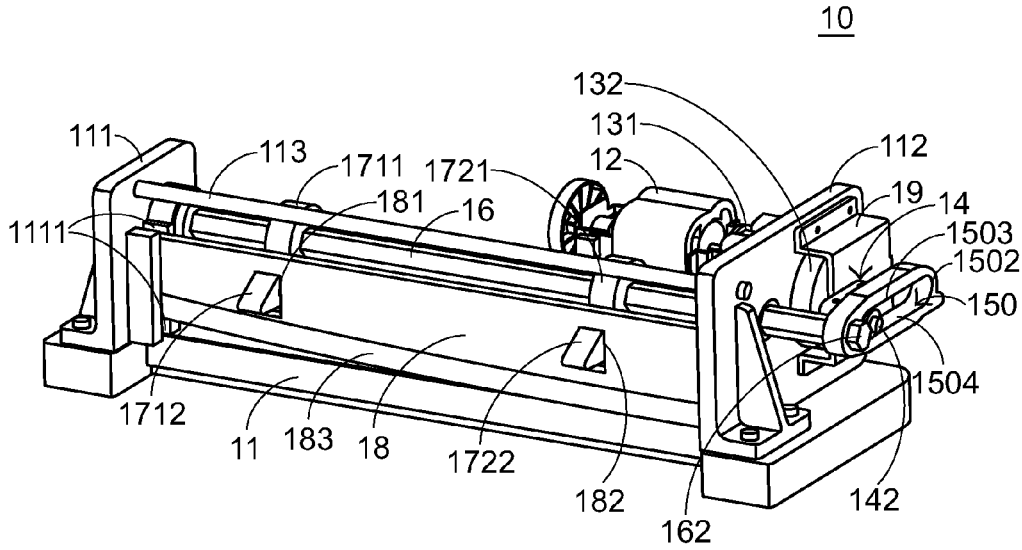
Figure 2A:
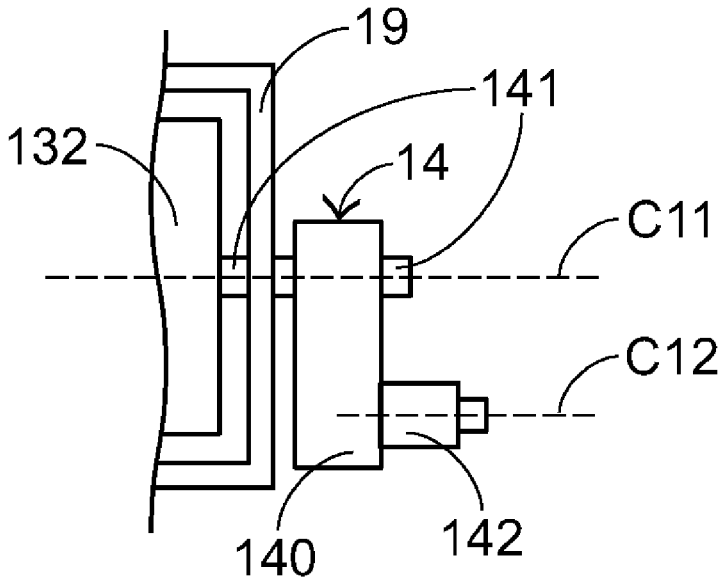
FIG. 2(*a*) is a schematic partial side view illustrating the second gear part, the protective casing and the protrusion member included in the cutting apparatus of FIG. 1.
Figure 2B:
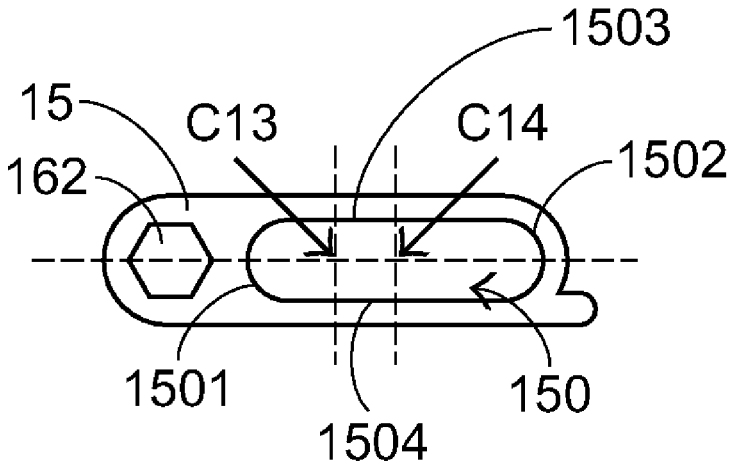

Hereinafter, the successive operations of a cutting apparatus according to the present invention will be illustrated in more details with reference to FIGS. 1(*a*), 1(*b*), 1(*c*) and 1(*d*). In FIG. 1(*a*), the cutting apparatus 10 is operated in a standby mode. In FIG. 1(*b*), the cutting member 18 of the cutting apparatus 10 is lowered and a cutting operation is being implemented. In FIG. 1(*c*), the cutting operation of the cutting member 18 has been implemented. In FIG. 1(*d*), the cutting member 18 of the cutting apparatus 10 is uplifted. FIGS. 2(*a*) and 2(*b*) are partial side and front views illustrating some components included in the cutting apparatus of FIG. 1(*a*), respectively.

Please refer to FIG. 1(*a*) and also FIG. 2. The cutting apparatus 10 principally includes a cutting platform 11, a motor 12, a gear set 13, a protrusion member 14, a gliding block 15, a rotating shaft 16, two handling elements 171, 172, and a cutting member 18. A first lateral plate 111 and a second lateral plate 112 are respectively arranged at opposed sides of the cutting platform 11 in the length direction. A first guiding track 1111 and a second guiding track (not shown) are arranged on the first lateral plate 111 and the second lateral plate 112, respectively, and face to each other.

For facilitating the first lateral plate 111 and the second lateral plate 112 to be stably stood on the cutting platform 11 during the cutting operation, the first lateral plate 111 and the second lateral plate 112 are supported by a first inclined plate 1112 and a second inclined plate 1122, respectively. Moreover, a horizontal rod 113 is interconnected between the first lateral plate 111 and the second lateral plate 112 in order to facilitate secure attachment of the cutting apparatus 10.

The cutting member 18 is movable along the first guiding track 1111 and the second guiding track in the upward or downward direction. The cutting member 18 has a knife edge 183 for cutting sheet articles such as papers. In this embodiment, the knife edge 183 is made slanted and curved. It is noted that, however, those skilled in the art will readily observe that numerous modifications and alterations of the knife edge 183 may be made while retaining the teachings of the invention. For example, the knife edge 183 having a wavy or saw-toothed structure is feasible for implementing the cutting operation.

The motor 12 is mounted on the cutting platform 11 and behind the cutting member 18. The gear set 13 includes a first gear part 131 and a second gear part 132. The first gear part 131 is disposed at a first surface of the second lateral plate 112 and rotatably connected to the motor 12. The second gear part 132 is disposed at a second surface of the second lateral plate 112, and connected to the protrusion member 14. For protecting the second gear part 132 from being touched by the user's hand or a part of the body, a protective casing 19 is provided between the second gear part 132 and the protrusion member 14 so as to enclose the second gear part 132.

The detailed operations of the cutting apparatus 10 will be illustrated with reference to FIGS. 1, 2(*a*) and 2(*b*). FIG. 2(*a*) is a schematic partial side view illustrating the second gear part 132, the protective casing 19 and the protrusion member 14. FIG. 2(*b*) is a schematic partial front view illustrating the gliding block 15.

As shown in FIGS. 2(*a*) and 2(*b*), the protrusion member 14 is substantially a crank including a protrusion arm 140, a first cylindrical post 141 and a second cylindrical post 142. The first cylindrical post 141 and the second cylindrical post 142 are formed on an upper end and a lower end of the protrusion arm 140. The first cylindrical post 141 penetrates through an opening (not shown) of the protective casing 19 and is pivotally coupled to the second gear part 132 at the center line C11 of the second gear part 132. Under this circumstance, the center line C12 of the second cylindrical post 142 is shifted from the center line C11 of the second gear part 132. When the second gear part 132 is rotated, the second cylindrical post 142 is driven to permit eccentric rotation with respect to the center line C11 of the second gear part 132.

FIG. 2(*b*) is a schematic partial side view illustrating the gliding block 15. The gliding block 15 includes a hollow gliding channel 150. The hollow gliding channel 150 is defined by a first arc-shaped end part 1501, a second arc-shaped end part 1502, a first sidewall 1503 and a second sidewall 1504. The first sidewall 1503 and the second sidewall 1504 are parallel with each other and connected between the first arc-shaped end part 1501 and the second arc-shaped end part 1502. The second cylindrical post 142 is received within the hollow gliding channel 150 of the gliding block 15. When the second cylindrical post 142 is rotated with respect to the center line C11 of the second gear part 132, the second cylindrical post 142 is linearly moved along the hollow gliding channel 150 back and forth.

The center line C14 of the hollow gliding channel 150 is shifted from the center line C13 of the gliding block 15. An end of the gliding block 15 is coupled to the second end 162 of the rotating shaft 16 such that the rotating shaft 16 is rotated with synchronous movement of the gliding block 15.

Please refer to FIG. 1(*a*) again. The handling elements 171, 172 include ring-shaped collars 1711, 1721 beside the first end 161 and the second end 162 of the rotating shaft 16, respectively. The ring-shaped collars 1711 and 1721 are sheathed around the rotating shaft 16. The first end 161 and the second end 162 of the rotating shaft 16 penetrate through the first lateral plate 111 and the second lateral plate 112, so that the rotating shaft 16 is rotatable between the first lateral plate 111 and the second lateral plate 112. The handling elements 171, 172 further includes protrusion rods 1712, 1722 extended from the ring-shaped collars 1711, 1721, respectively. The protrusion rods 1712 and 1722 penetrate through corresponding holes 181 and 182 of the cutting member 18, respectively.

In some embodiments, the protrusion rods 1712 and 1722 have inclined upper surfaces sustained against the upper walls of the holes 181 and 182 of the cutting member 18. Due to the inclined upper surfaces of the protrusion rods 1712 and 1722, the frictional force generated between the protrusion rods 1712, 1722 and the holes 181, 182 when the cutting member 18 is uplifted or lowered is reduced. It is noted that, however, those skilled in the art will readily observe that numerous modifications and alterations of the protrusion rods 1712 and 1722 may be made while retaining the teachings of the invention. For example, the protrusion rods 1712 and 1722 may have inclined lower surfaces. Alternatively, the protrusion rods 1712 and 1722 may have inclined upper surfaces and inclined lower surfaces.

For illustration, the gliding block 15, the rotating shaft 16 and the handling elements 171, 172 are cooperatively referred as a rotational direction switching unit. By means of the rotational direction switching unit, the circular motion of the protrusion member 14 is switched to the linear cutting motion of the cutting member 18.

Please refer to FIGS. 1(*a*), 1(*b*), 1(*c*) and 1(*d*). The successive operations of the cutting apparatus 10 will be illustrated as follows.

In FIG. 1(*a*), the cutting apparatus 10 is operated in a standby mode. Meanwhile, the second cylindrical post 142 of the protrusion member 14 is embedded in the hollow gliding channel 150 at substantially the middle position thereof. In addition, the inclined upper surfaces of the protrusion rods 1712 and 1722 are sustained against the upper walls of the holes 181 and 182 of the cutting member 18. Under this circumstance, the cutting member 18 is located at the uppermost positions of the first guiding track 1111 and the second guiding track.

After the motor 12 is started, the gear set 13 and the protrusion member 14 are driven to rotate along an anti-clockwise direction, and thus the gliding block 15 is synchronously rotated along the anti-clockwise direction with rotation of the protrusion member 14. As a result, the second cylindrical post 142 is moved along the hollow gliding channel 150 toward the second arc-shaped end part 1502, as is shown in FIG. 1(*b*). According to the lever principle, the junction between the gliding block 15 and the second end 162 of the rotating shaft 16 is swung downwardly. Meanwhile, the lower surfaces of the protrusion rods 1712 and 1722 are downwardly sustained against the lower walls of the holes 181 and 182 of the cutting member 18, and thus a cutting operation begins.

The gear set 13 and the protrusion member 14 are continuously driven by the motor 12 to rotate along the anti-clockwise direction. As the gliding block 15 is synchronously rotated along the anti-clockwise direction with rotation of the protrusion member 14, the second cylindrical post 142 is moved along the hollow gliding channel 150 from the second arc-shaped end part 1502 to the middle position thereof, as is shown in FIG. 1(*c*). Meanwhile, the cutting operation has been completely implemented.

The gear set 13 and the protrusion member 14 are continuously driven by the motor 12 to rotate along the anti-clockwise direction. As the gliding block 15 is synchronously rotated along the anti-clockwise direction with rotation of the protrusion member 14, the second cylindrical post 142 is moved along the hollow gliding channel 150 toward the first arc-shaped end part 1501, as is shown in FIG. 1(*d*). Similarly, according to the lever principle, the junction between the gliding block 15 and the second end 162 of the rotating shaft 16 is swung upwardly. Meanwhile, the inclined upper surfaces of the protrusion rods 1712 and 1722 are upwardly sustained against the upper walls of the holes 181 and 182 of the cutting member 18, thereby uplifting the cutting member 18.

As the gear set 13 and the protrusion member 14 are continuously driven by the motor 12 to rotate along the anti-clockwise direction, the second cylindrical post 142 is moved along the hollow gliding channel 150 from the first arc-shaped end part 1501 to the middle position thereof, as is shown in FIG. 1(*a*). Meanwhile, the cutting member 18 is moved along the first guiding track 1111 and the second guiding track to the uppermost ends thereof again.

Figure 3:
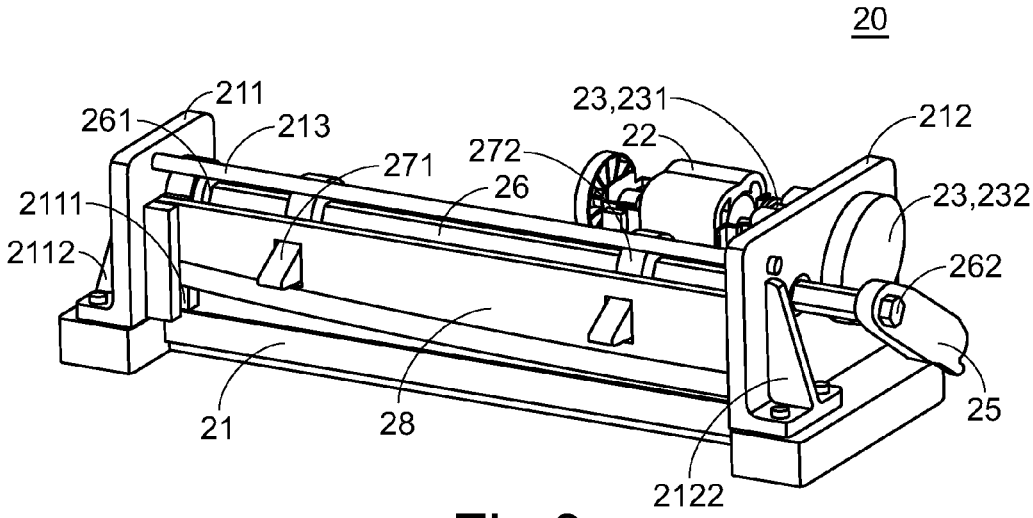
FIG. 3 is a schematic perspective view of a cutting apparatus according to another preferred embodiment of the present invention.

A further embodiment of a cutting apparatus 20 is illustrated in FIG. 3. In this embodiment, the cutting platform 21, the motor 22, the gear set 23, the rotating shaft 26, the handling elements 271, 272 and the cutting member 28 included therein are similar to those shown in FIG. 1(*a*), and are not redundantly described herein.

A first lateral plate 211 and a second lateral plate 212 are respectively arranged at opposed sides of the cutting platform 11 in the length direction. A first guiding track 2111 and a second guiding track (not shown) are arranged on the first lateral plate 211 and the second lateral plate 212, respectively, and face to each other.

For facilitating the first lateral plate 211 and the second lateral plate 212 to be stably stood on the cutting platform 21 during the cutting operation, the first lateral plate 211 and the second lateral plate 212 are supported by a first inclined plate 2112 and a second inclined plate 2122, respectively. Moreover, a horizontal rod 213 is interconnected between the first lateral plate 211 and the second lateral plate 212 in order to facilitate secure attachment of the cutting apparatus 20.

Figure 4A:
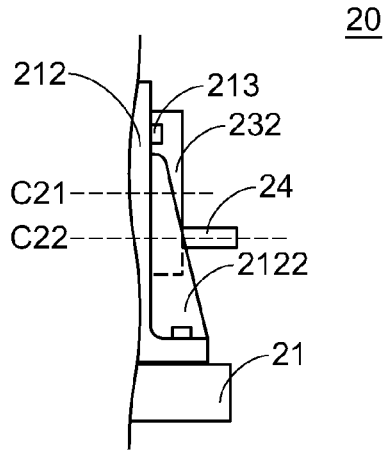
FIG. 4(*a*) is a schematic partial side view illustrating the second gear part of the gear set and the protrusion member included in the cutting apparatus of FIG. 3.
Figure 4B:
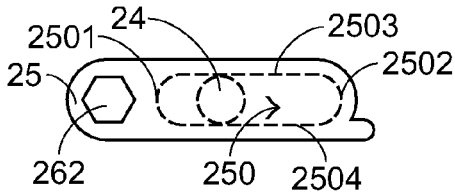

In comparison with the cutting apparatus 10 shown in FIG. 1(*a*), the protrusion member 24 and the gliding block 25 included in the cutting apparatus 20 of this embodiment is distinguished and the protective casing 19 used in FIG. 1(*a*) is dispensed with. FIG. 4(*a*) is a schematic partial side view illustrating the second gear part 232 of the gear set 23 and the protrusion member 24. The protrusion member 24 is substantially a cylindrical post disposed on a side surface of the second gear part 232. Moreover, the center line C22 of the cylindrical post 24 is shifted from the center line C21 of the second gear part 232. When the second gear part 232 is rotated, the cylindrical post 24 is driven to permit eccentric rotation with respect to the center line C21 of the second gear part 232.

FIG. 4(*b*) is a schematic partial side view illustrating the gliding block 25. The gliding block 25 includes a gliding channel 250. The gliding channel 250 is defined by a first arc-shaped end part 2501, a second arc-shaped end part 2502, a first sidewall 2503, a second sidewall 2504 and a bottom surface (not shown). The first sidewall 2503 and the second sidewall 2504 are parallel with each other and connected between the first arc-shaped end part 2501 and the second arc-shaped end part 2502. The cylindrical post 24 is received within the gliding channel 250 of the gliding block 25. After the cylindrical post 24 is rotated with respect to the center line C21 of the second gear part 232 for a revolution, the cylindrical post 24 is linearly moved along the gliding channel 250 back and forth.

Similarly, the gliding block 25, the rotating shaft 26 and the handling elements 271, 272 are cooperated to switch the circular motion of the protrusion member 24 to the linear cutting motion of the cutting member 28. The detailed operation principles of rendering the linear cutting motion of the cutting member 28 are similar to those shown in the first preferred embodiment, and are not redundantly described herein.

Moreover, the cutting apparatus of the present invention is capable of cutting various sheet articles with different thickness by changing the gear ratio of the gear set. As a result, the cutting apparatus of the present invention is advantageous of having extensible applications and simple configurations.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A cutting apparatus comprising: a cutting platform;

a first lateral plate and a second lateral plate arranged at opposed sides of said cutting platform;

a first guiding track and a second guiding track arranged on said first lateral plate and said second lateral plate, respectively, and facing to each other; a motor disposed on said cutting platform; a gear set including a first gear part and a second gear part disposed on a first surface and a second surface of said second lateral plate, respectively, wherein said first gear part is connected to said motor, said second gear part is connected to a protrusion member, and the center line of said protrusion member is shifted from the center line of said second gear part;

a cutting member arranged between said first guiding track and said second guiding track and movable along said first guiding track and said second guiding track; and a rotational direction switching unit interconnected between said protrusion member and said cutting member and including:

a gliding channel for receiving said protrusion member therein and a rotating shaft having a handling element fixed relative thereto in a manner that allows said handling element to experience a substantially similar degree of rotation as said rotating shaft, wherein said rotational direction switching unit renders a linear cutting operation of said cutting member when said protrusion member is driven by said gear set to rotate in a circular motion, a gliding block including said gliding channel for receiving said protrusion member therein, said protrusion member being linearly moved along said gliding channel back and forth when said protrusion member is rotated in said circular motion, wherein the center line of said gliding channel is shifted from the center line of said gliding block, wherein said rotating shaft has a first end and a second end penetrating through said first lateral plate and said second lateral plate, respectively, wherein said second end of said rotating shaft is connected to an end of said gliding block such that said rotating shaft is rotated with synchronous linear movement of said protrusion member in said gliding block, wherein said handling element has a first end sheathed around said rotating shaft and a second end in contact with a sidewall of a hole of said cutting member, and wherein said handling element is upwardly or downwardly sustained against said sidewall of said hole such that said cutting member is linearly moved along said first guiding track and said second guiding track.

2. The cutting apparatus according to claim 1 wherein said first guiding track and said second guiding track are arranged in a vertical direction such that said cutting member is moved along said first guiding track and said second guiding track to implement said linear cutting operation in said vertical direction.

3. The cutting apparatus according to claim 1 wherein said protrusion member is a cylindrical post disposed on a side surface of the second gear part.

4. The cutting apparatus according to claim 1 wherein said protrusion member is substantially a crank including a protrusion arm, a first cylindrical post and a second cylindrical post, said first cylindrical post and said second cylindrical post are respectively formed on an upper end and a lower end of said protrusion arm, and said first cylindrical post is pivotally coupled to said gear set at the center line thereof such that the center line of said second cylindrical post is shifted from the center line of said gear set.

5. The cutting apparatus according to claim 1 wherein said cutting member has a slanted and curved knife edge.

6. The cutting apparatus according to claim 1 wherein said gliding channel is a hollow gliding channel defined by a first arc-shaped end part, a second arc-shaped end part, a first sidewall and a second sidewall, wherein said first sidewall and the second sidewall are parallel with each other and connected between said first arc-shaped end part and said second arc-shaped end part.

7. The cutting apparatus according to claim 1 wherein said gliding channel is adjacent to a side of said gliding block, and defined by a first arc-shaped end part, a second arc-shaped end part, a first sidewall, a second sidewall and a bottom surface, wherein said first sidewall and the second sidewall are parallel with each other and connected between said first arc-shaped end part and said second arc-shaped end part.

8. The cutting apparatus according to claim 1 wherein said handling element includes:

a ring-shaped collar sheathed around said rotating shaft; and a protrusion rod extended from said ring-shaped collar and sustained against said sidewall of said hole.

9. The cutting apparatus according to claim 8 wherein said protrusion rod of said handling element has an inclined upper surface and/or an inclined lower surface sustained against said sidewall of said hole.

10. A cutting apparatus comprising: a motor; a first lateral plate and a second lateral plate;

a first guiding track and a second guiding track arranged on said first lateral plate and said second lateral plate, respectively;

a gear set including a first gear part and a second gear part disposed on a first surface and a second surface of said second lateral plate, respectively, wherein said first gear part is connected to said motor, said second gear part is connected to a protrusion member, and the center line of said protrusion member is shifted from the center line of said second gear part;

a cutting member arranged between said first guiding track and said second guiding track and movable along said first guiding track and said second guiding track;

a rotating shaft having a first end and a second end penetrating through said first lateral plate and said second lateral plate, respectively, wherein said second end of said rotating shaft is adjacent to said protrusion member;

a gliding block interconnected between said protrusion member and said rotating shaft and including a gliding channel for receiving said protrusion member therein, said second end of said rotating shaft being connected to an end of said gliding block such that said rotating shaft is rotated with synchronous linear movement of said protrusion member of said gliding block, wherein said protrusion member is linearly moved along said gliding channel back and forth when said protrusion member is driven by said gear set to rotate in a circular motion;

a handling element fixed relative to said rotating shaft in a manner that allows said handling element to experience a substantially similar degree of rotation as said rotating shaft; and a cutting structure in which said cutting member is pivotally coupled to said rotating shaft by said handling element and in which said cutting member is movable along said first guiding track and said second guiding track in response to rotation of said rotating shaft, said handling element includes a ring-shaped collar sheathed around said rotating shaft and a protrusion rod extended from said ring-shaped collar and sustained against a sidewall of a hole of said cutting member.

11. The cutting apparatus according to claim 10 wherein said protrusion member is a cylindrical post disposed on a side surface of the second gear part.

12. The cutting apparatus according to claim 10 wherein said protrusion member is substantially a crank including a protrusion arm, a first cylindrical post and a second cylindrical post, said first cylindrical post and said second cylindrical post are respectively formed on an upper end and a lower end of said protrusion arm, and said first cylindrical post is pivotally coupled to said gear set at the center line thereof such that the center line of said second cylindrical post is shifted from the center line of said gear set.

13. The cutting apparatus according to claim 10 wherein said gliding channel is adjacent to a side of said gliding block, and defined by a first arc-shaped end part, a second arc-shaped end part, a first sidewall, a second sidewall and a bottom surface, wherein said first sidewall and the second sidewall are parallel with each other and connected between said first arc-shaped end part and said second arc-shaped end part.

14. The cutting apparatus according to claim 10 wherein said gliding channel is a hollow gliding channel defined by a first arc-shaped end part, a second arc-shaped end part, a first sidewall and a second sidewall, wherein said first sidewall and the second sidewall are parallel with each other and connected between said first arc-shaped end part and said second arc-shaped end part.

15. The cutting apparatus according to claim 10 wherein said protrusion rod of said handling element has an inclined upper surface and/or an inclined lower surface sustained against said sidewall of said hole.

16. The cutting apparatus according to claim 10 wherein said cutting member has a slanted and curved knife edge.

17. The cutting apparatus according to claim 10 wherein said first guiding track and said second guiding track are arranged in a vertical direction such that said cutting member is moved along said first guiding track and said second guiding track to implement said linear cutting operation in said vertical direction.

* * * * *

UNITED STATES PATENT AND TRADEMARK OFFICE

CERTIFICATE OF CORRECTION

PATENT NO. : 7,591,211 B2
APPLICATION NO. : 11/625521
DATED : September 22, 2009
INVENTOR(S) : Tzu-Feng Tseng et al.

It is certified that error appears in the above-identified patent and that said Letters Patent is hereby corrected as shown below:

In column 1 line 19, please delete "1239280" and replace it with --I239280--.

Signed and Sealed this

Second Day of November, 2010

David J. Kappos

David J. Kappos
*Director of the United States Patent and Trademark Office*